US007644663B2

(12) United States Patent
Illesi

(10) Patent No.: US 7,644,663 B2
(45) Date of Patent: Jan. 12, 2010

(54) METHOD OF MAKING INACTIVE BALLISTIC EXERCISE ELEMENTS AND INACTIVE BALLISTIC ELEMENT MADE BY SAID METHOD

(75) Inventor: Giuliano Illesi, Sarcedo (IT)

(73) Assignee: Industria Meccanica Zane' SRL, Zane (VI) (IT)

( * ) Notice: Subject to any disclaimer, the term of this patent is extended or adjusted under 35 U.S.C. 154(b) by 732 days.

(21) Appl. No.: 11/320,896

(22) Filed: Dec. 29, 2005

(65) Prior Publication Data

US 2006/0266249 A1 Nov. 30, 2006

Related U.S. Application Data

(63) Continuation-in-part of application No. PCT/IB2004/002173, filed on Jun. 30, 2004.

(30) Foreign Application Priority Data

| | | |
|---|---|---|
| Jul. 4, 2003 | (IT) | VI03A0131 |
| Oct. 7, 2003 | (IT) | VI03A0197 |
| Mar. 5, 2004 | (IT) | VI04A0037 |
| Mar. 17, 2004 | (IT) | VI04A0058 |

(51) Int. Cl.
*F42B 8/00* (2006.01)

(52) U.S. Cl. ..... 102/498; 102/502; 102/529

(58) Field of Classification Search ..... 102/498, 102/499, 500, 502, 529
See application file for complete search history.

(56) References Cited

U.S. PATENT DOCUMENTS

| | | | | |
|---|---|---|---|---|
| 2,365,708 | A * | 12/1944 | Landen et. al. | 102/500 |
| 3,216,358 | A * | 11/1965 | Findeisen | 86/1.1 |
| 3,236,184 | A * | 2/1966 | Gawlick et. al. | 102/529 |
| 3,442,205 | A * | 5/1969 | Heinz et. al. | 102/503 |
| 3,463,047 | A * | 8/1969 | Germershausen | 86/23 |
| 3,517,619 | A * | 6/1970 | Niemann | 102/529 |
| 3,732,826 | A * | 5/1973 | Johnson | 102/444 |
| 3,916,795 | A * | 11/1975 | Lemstra | 102/529 |
| 4,109,579 | A * | 8/1978 | Carter | 102/513 |
| 4,446,794 | A * | 5/1984 | Simmons | 102/513 |
| 4,716,834 | A * | 1/1988 | Wallow et al. | 102/519 |
| 2002/0056395 | A1 * | 5/2002 | Gatti | 102/395 |

FOREIGN PATENT DOCUMENTS

| | | |
|---|---|---|
| CH | 167543 | 2/1934 |
| DE | 19546049 A1 | 6/1997 |
| DE | 10163414 A1 | 7/2003 |
| DE | 10163415 A1 | 7/2003 |

(Continued)

*Primary Examiner*—David J Parsley
(74) *Attorney, Agent, or Firm*—IP Strategies

(57) ABSTRACT

An inactive aerial ballistic element for exercises includes a main hollow body and a ballast element. The main hollow body has an ogive, disposed in the front portion, and a closure bottom, disposed in the rear portion. The ballast element is disposed in the main hollow body, and gives to the inactive ballistic element the same ballistic features of active ballistic elements. The ballast element includes at least a monolithic body coaxially disposed in the main hollow body of the inactive ballistic element and extending at least between the ogive and the closure bottom. The ogive includes the end of the monolithic body, which protrudes from the main hollow body of the inactive ballistic element.

20 Claims, 7 Drawing Sheets

FOREIGN PATENT DOCUMENTS

| | | | |
|---|---|---|---|
| EP | 0407288 | * | 1/1991 |
| EP | 0597142 A1 | | 5/1994 |
| EP | 0626557 | * | 11/1994 |
| FR | 692684 | | 11/1930 |
| FR | 1449229 | | 8/1966 |
| FR | 2196065 | | 3/1974 |
| GB | 1080147 | | 8/1967 |
| GB | 1401376 | | 7/1975 |

* cited by examiner

METHOD OF MAKING INACTIVE BALLISTIC EXERCISE ELEMENTS AND INACTIVE BALLISTIC ELEMENT MADE BY SAID METHOD

BACKGROUND OF THE INVENTION

The invention is about a method of making inactive ballistic exercise elements and an inactive ballistic element made according to said method's teachings.

It is known that for ballistic element it is intended, in the widest meaning of the word, any object which is launched by fire-arms and also self-propelled objects like for instance missiles or rockets.

It is likewise known that, for exercises and training purpose, inactive ballistic elements without explosive charge are used, which serve only to study the ballistic movement in order to simulate the launch on a target of said ballistic element without the presence of explosive elements.

In the following description, a specific inactive ballistic element will be considered, consisting of an inactive bomb body used for exercises and dropped by aircrafts; however, it is intended that what described hereinafter could be extended to any other kind of inactive bomb body and generally to any inactive ballistic element.

It is known that the aerial bombs nowadays in production substantially reproduce four bomb models, manufactured according to the American standards and respectively identified with the acronyms MK-81-82-83-84.

Said bombs can be of active type, i.e. charged with explosive material, suitable for being used in military operations, or of inactive type, i.e. filled with aggregate, used for training purposes.

In both cases, aerial bombs comprise a bomb body, to which a vane in the rear portion and a cap in the front portion are applied.

Concerning the inactive bomb bodies belonging to the prior art, although in their different specific embodiments, they substantially comprise a main hollow body in which an ogive, disposed in the front portion, and a tail ring, disposed in the rear portion, are present.

Inside the main hollow body an inactive ballast is disposed, consisting of a mixture mainly composed by cement, able to give to the bomb body the same ballistic features of active bomb bodies.

In particular, the main hollow body is manufactured with one or more components, by hot forging of a metal tubular element.

With such manufacture, the main hollow body takes the planned tapered shape able to grant, also by a gradual variation of the main hollow body wall thickness, the required barycentre positioning, moment of inertia and other ballistic features.

The subsequent filling of the main hollow body takes place, as previously mentioned, using a single aggregate, generally a cement mixture which, once solidified, becomes integral with the body, giving it the same weight and ballistic features of the similar active bomb bodies used in military operations. In particular, the main hollow body of inactive bomb bodies is the same used in active bomb bodies, which are different from inactive ones only for the explosive nature of the filling material.

Once completed the filling operation, performed through the opening present in the rear portion of the main hollow body, the latter is closed with a closure bottom flange-shaped screwed on the tail ring.

Housings for the rings for suspending the bomb body to an aircraft are furthermore provided on the outer surface of the bomb body.

However, the hereby described well known bomb bodies have some acknowledged inconveniences.

A first inconvenience is due to the fact that bomb bodies are not recyclable once used, for the impossibility to separate in a cheap way the metallic main hollow body from the filling cement material used to give to the bomb body the same ballistic features of active bombs.

As a consequence, the hereby described well known inactive bomb bodies have to be discharged in proper dumps and/or dedicated sites after their use, with consequent increase of managing costs, impossibility of recycling and reusing the metallic material of which the main hollow body is made and environment pollution.

Another acknowledged inconvenience is related to the technical and constructional complexity and to the considerable time needed to fill the main hollow body using cement aggregates.

In particular the cement material, once loaded inside the main hollow body, should be let solidify for a predetermined time interval.

The present invention intends to solve the aforesaid inconveniences.

SUMMARY OF THE INVENTION

It is a first object of the invention to provide for an inactive ballistic element, in particular an inactive aerial bomb body for exercises, which can be easily and economically recycled, to recover metallic material and aggregate contained therein, avoiding as well to discharge the used ballistic elements in proper dumps and/or dedicated sites.

It is another object of the invention to provide for an inactive ballistic element, in particular an inactive aerial bomb body for exercises, which simplifies the known constructive technique and makes easier and more rapid the filling operation of the main hollow body.

Said objects are attained by carrying out a method of making inactive ballistic elements, in particular inactive aerial bombs body for exercises, which according to the contents of the main claim is characterized by comprising the following operations:

- forming the main hollow body of said inactive ballistic element;
- placing a removable ballast element in said main hollow body, able to give to said inactive ballistic element the same ballistic features of active ballistic elements;
- connecting a closure bottom to the rear portion of said main hollow body.

Advantageously, the use of a removable ballast element allows to recycle the ballistic element after its use, recovering the metallic material of which it is made and avoiding its waste in the environment.

BRIEF DESCRIPTION OF THE DRAWINGS

The aforesaid objects and advantages will be better highlighted in the description of preferred embodiments of the invention, given in an explanatory but not limiting way, with reference to the figures of the annexed drawings, wherein.

Figure 4:
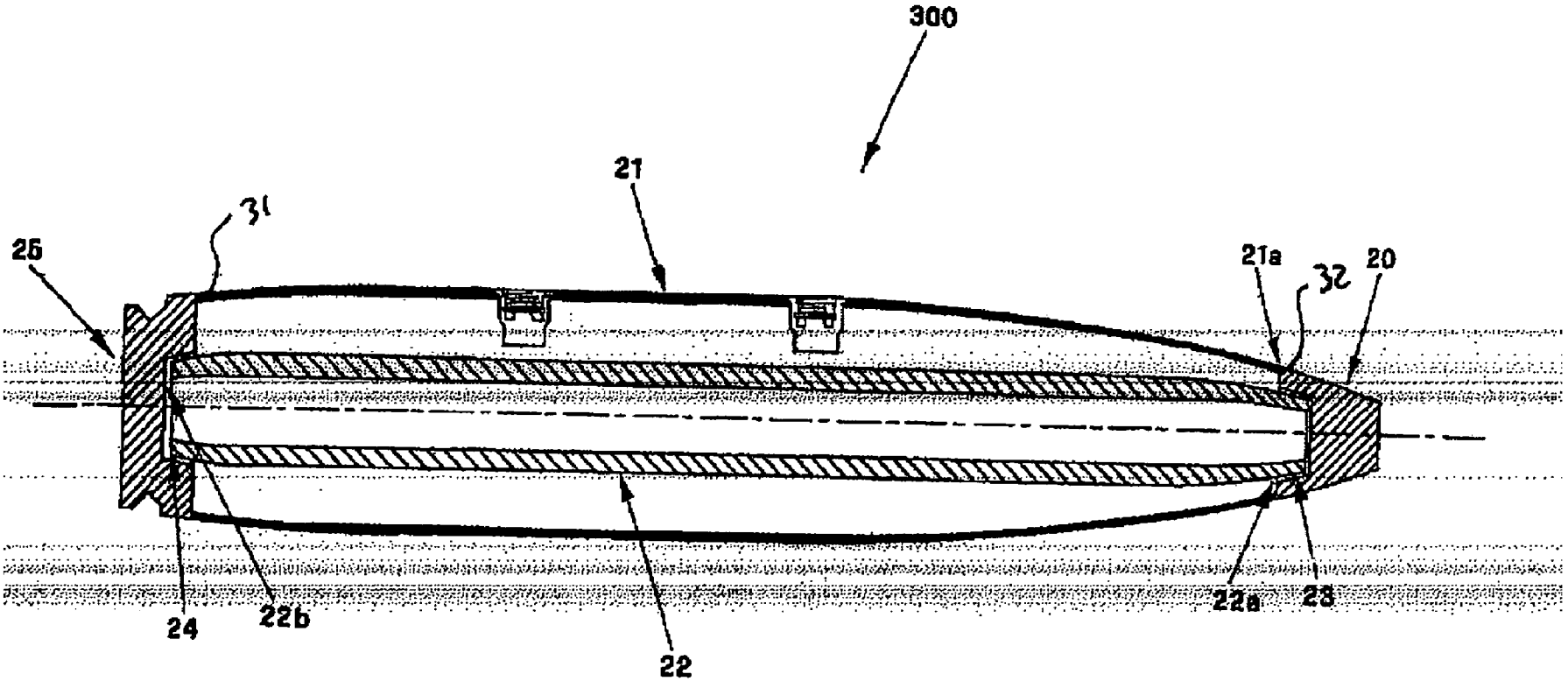
Figure 5:
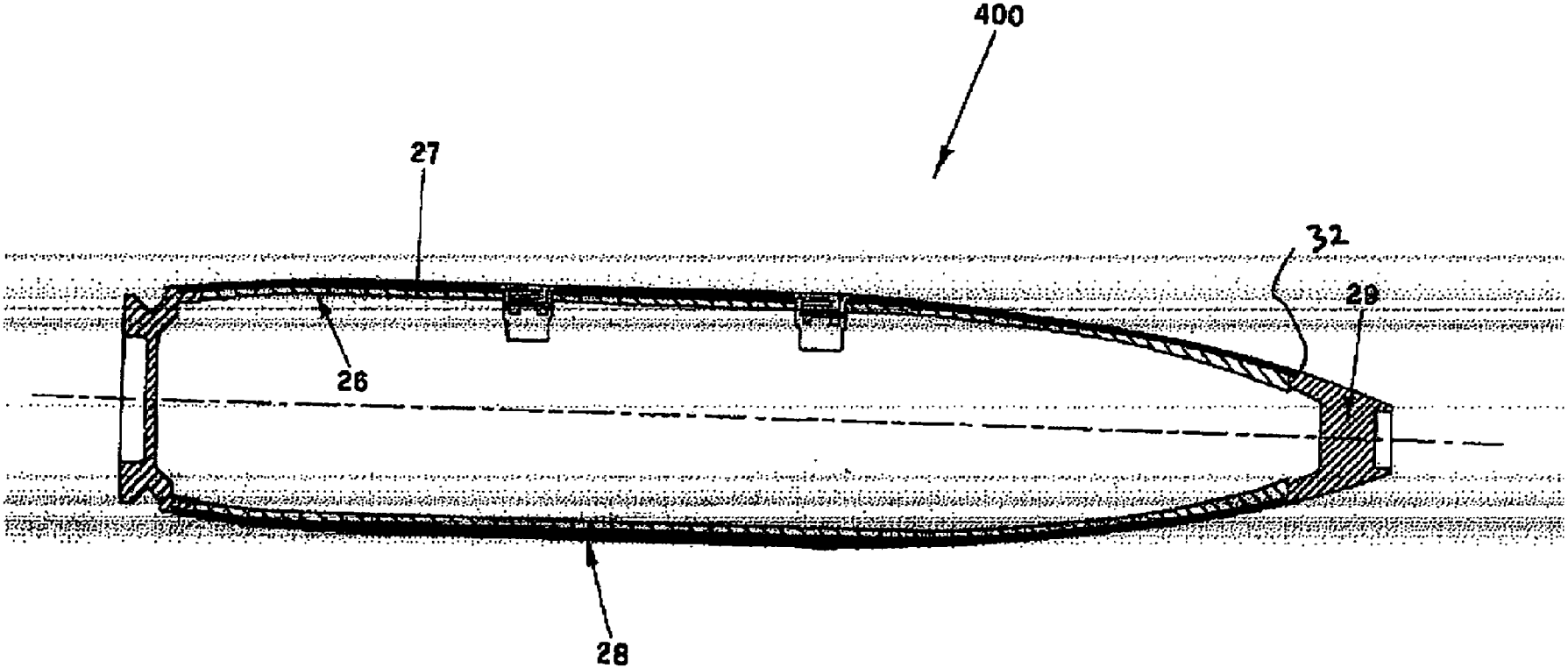
Figure 6:
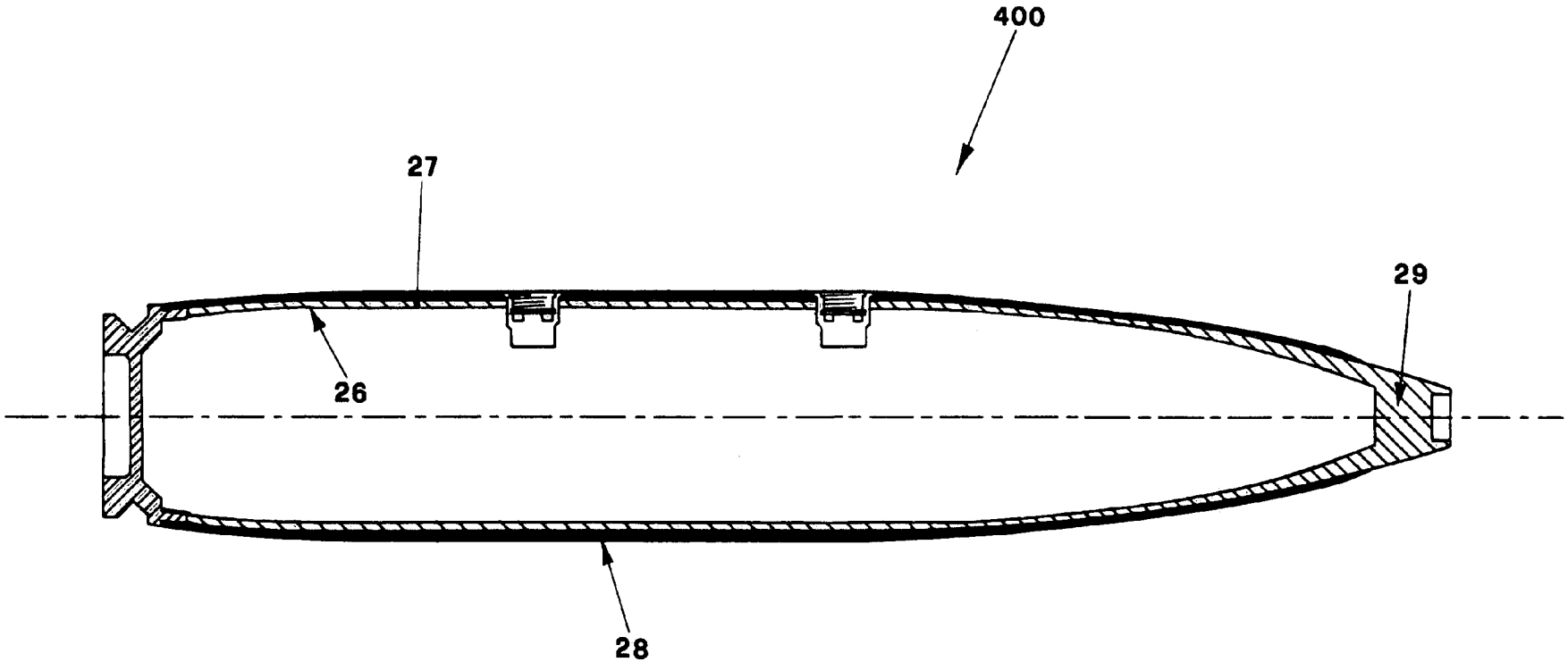

FIG.s 2 and 3 are sectional views of two executive embodiments of the invention;

FIG. 4 is a sectional view of a further executive embodiment of the invention;

FIG. 5 is a sectional view of a further executive embodiment of the invention;

FIG. 6 shows a variant of the embodiment of FIG. 4; and

Figure 7:
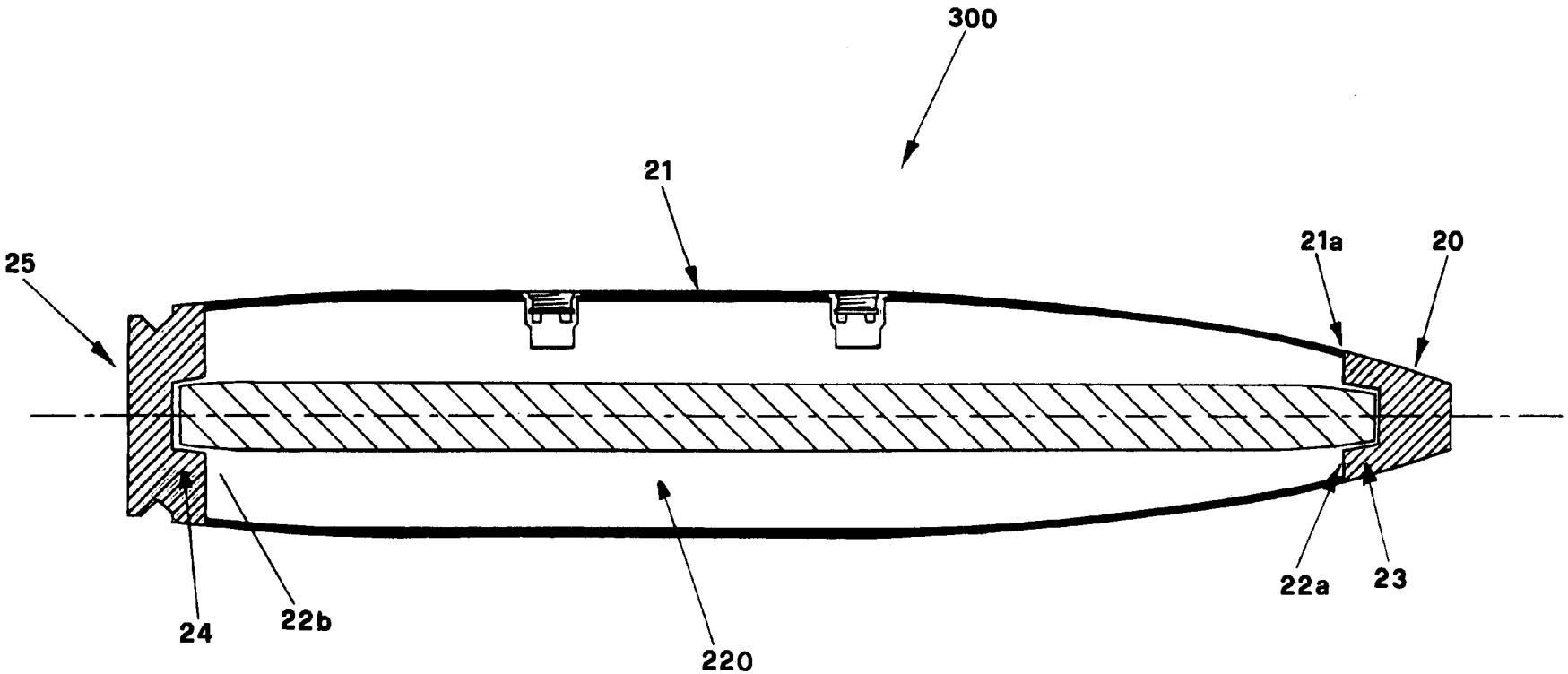

FIG. 7 shows a further executive embodiment of the invention.

DESCRIPTION OF THE INVENTION

Figure 1:
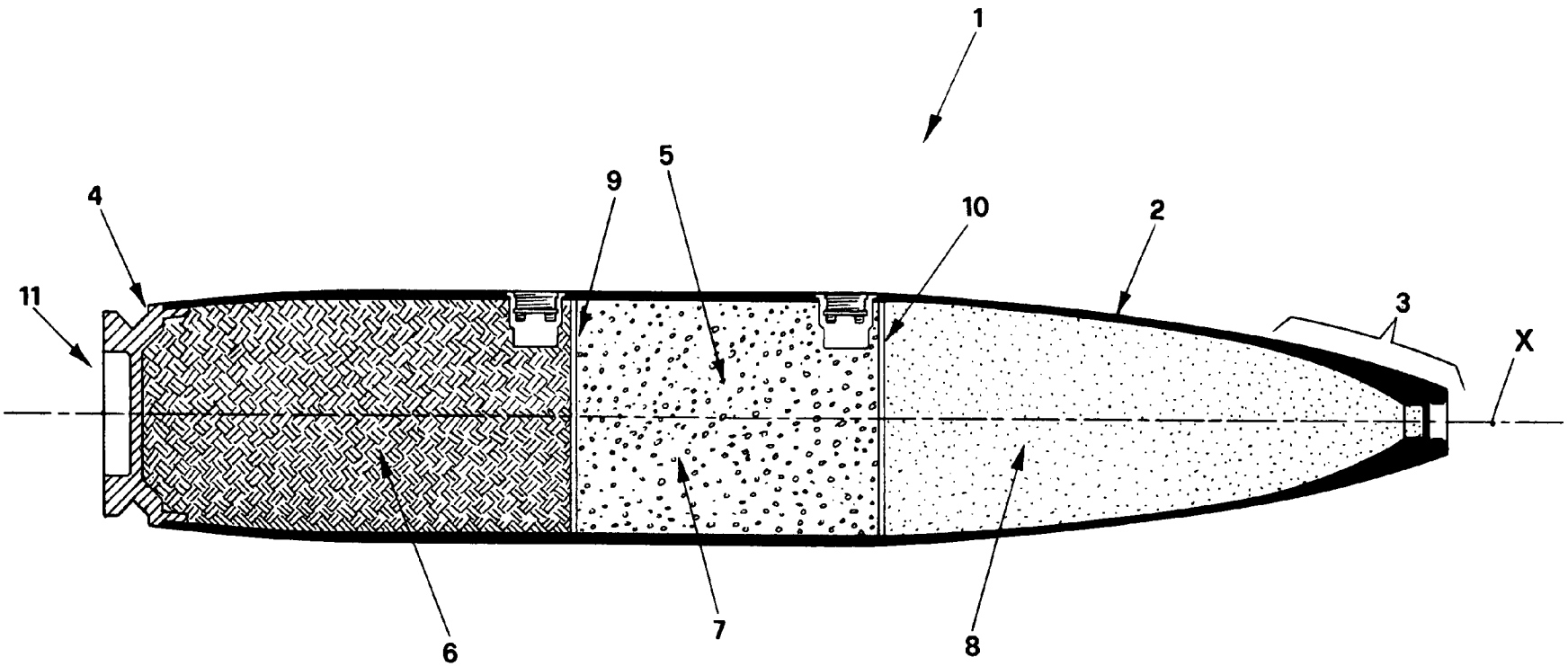
FIG. 1 is a sectional view of the bomb body of the invention.

As one can see in FIG. 1, the inactive aerial bomb body for exercises of the invention, generally indicated with numeral 1, comprises a main hollow body 2 in which an ogive 3, disposed in the front portion, and a tail ring 4, disposed in the rear portion, are present, and inside which a ballast element 5, able to give to the inactive bomb body 1 the same ballistic features of active bomb bodies, is placed.

According to the invention, the moulding of the main hollow body 2 is performed by cold deformation of a metal tubular element, in order to give to said main hollow body 2 the planned tapered shape able to grant, also by a gradual variation of the main hollow body 2 wall thickness, the desired ballistic features of the inactive bomb body 1.

Subsequently, the main hollow body 2 is filled with the ballast element 5, consisting of one or more granulated aggregates 6, 7 and 8 which are disposed in overlapping layers, separated by dividing screens 9 and 10, according to the longitudinal axis X of the main hollow body 2.

The choice of the nature of the aggregates 6, 7 and 8 used and of the layers thickness is the result of accurate calculations able to ensure the perfect correspondence of barycentre, moment of inertia and other ballistic features with those of the respective active bomb bodies.

Furthermore, said aggregates 6, 7 and 8 are separable from the main hollow body 2, so that the metal of which it is made can be easily recovered and recycled after the exercising launch of the inactive bomb 1.

Finally, the main hollow body 2 is closed in its rear portion with a closure bottom flange-shaped 11 screwed on the tail ring 4.

Figure 2:
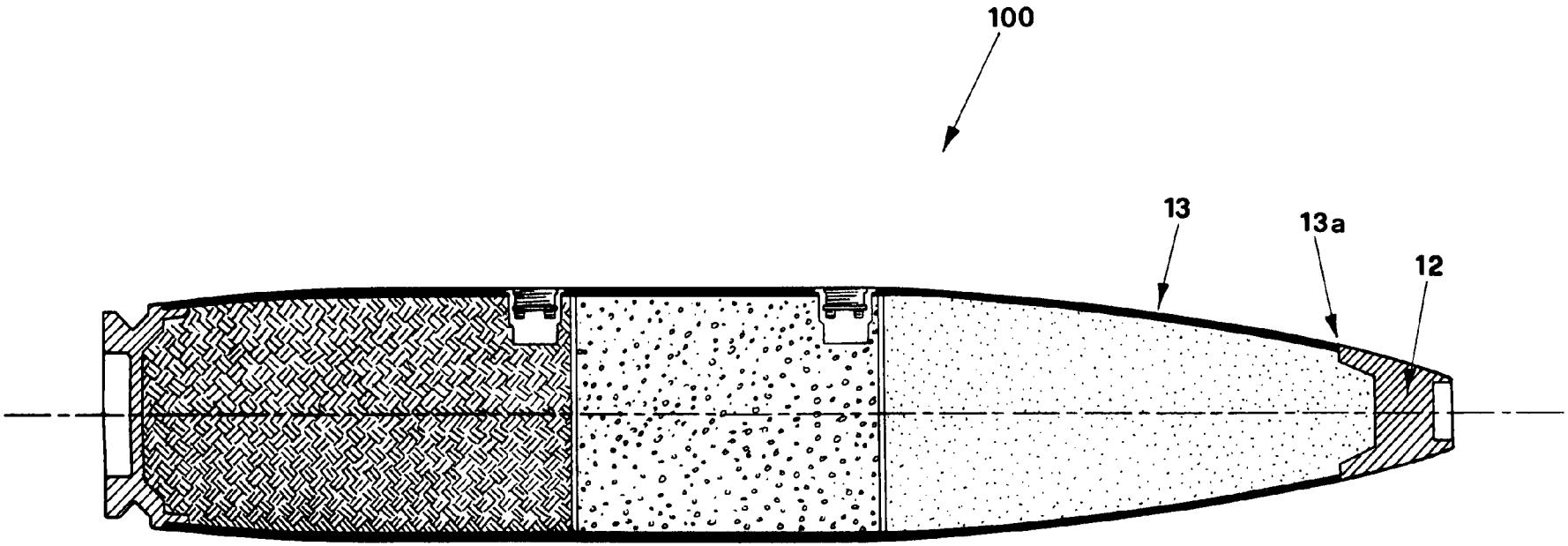

As described above, the main hollow body 2 and the ogive 3 are made enbloc by cold deformation of a metal tubular element; however, in other executive embodiments 100, shown in FIG. 2, the ogive 12 could be a separate element, made for example by chip-forming machining, which is welded in the front portion 13*a* of the main hollow body 13.

Figure 3:
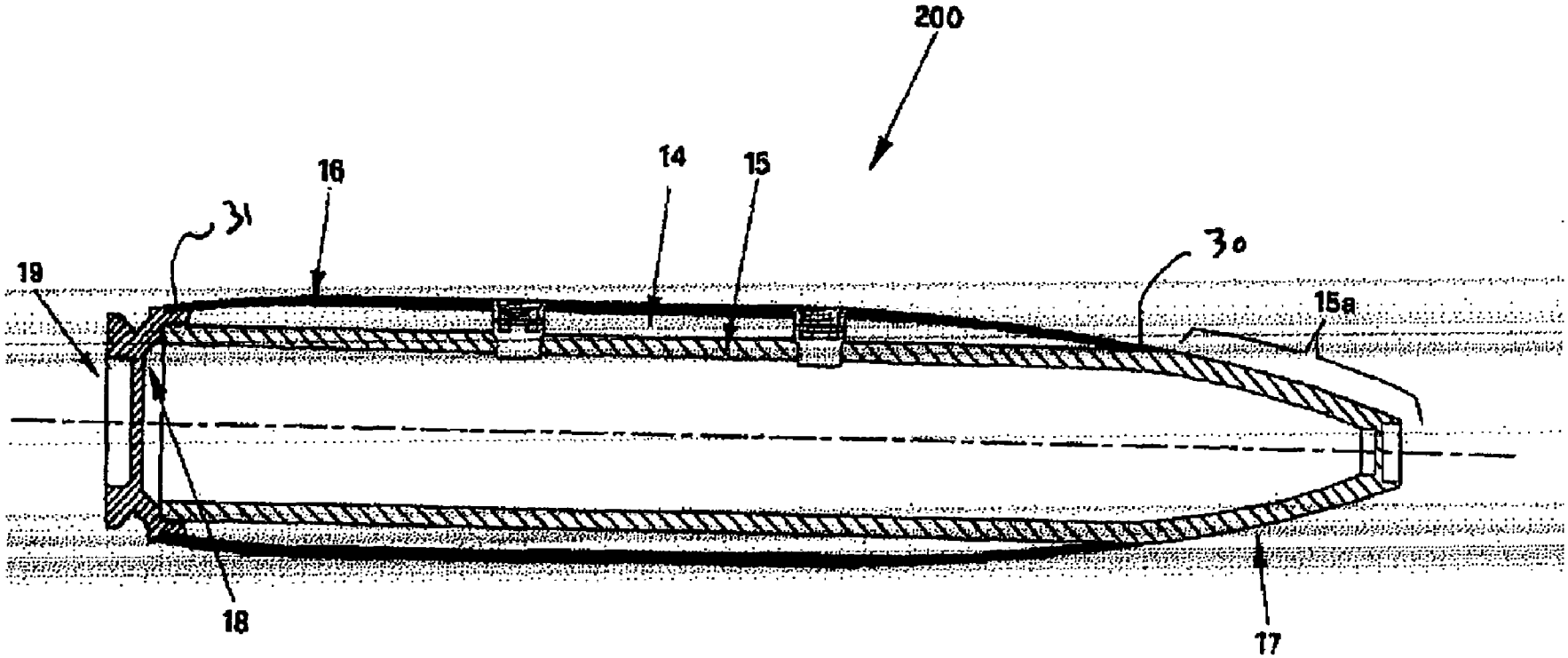

According to another executive embodiment of the inactive bomb body of the invention, shown in FIG. 3, where it is generally indicated with numeral 200, the ballast element 14 comprises a monolithic body 15 coaxially disposed inside the main hollow body 16, and mutually connected, for example, at a welded joint 30.

In particular, the ogive 17 comprises the end 15*a* of the monolithic body 15, with which is formed enbloc, protruding from the main hollow body 16 of the inactive bomb body 200.

Concerning the monolithic body 15, it preferably but not necessarily consists of a metal pipe having proper thickness, diameter and length, suitable for being coupled with a respective self-centering seat 18 internally obtained in the closure bottom 19 which, as previously described, is connected to the main hollow body 16 by welding, for example, at a welded joint 31.

In other not shown executive embodiments, the monolithic body could be also made by a solid metal bar or by other materials suitable anyhow to ensure the perfect correspondence of barycentre, moment of inertia and other ballistic features of the inactive bomb body with the ones of the respective active bomb bodies.

The executive embodiment shown In FIG. 4, generally indicated with numeral 300, differs from the previously described one in that the ogive 20 is a separate element, manufactured by chip-forming machining, which is welded, for example at a welded joint 32, in the front portion 21*a* of the main hollow body 21.

In this case, the monolithic body 22 comprises a first end 22*a*, able to be coupled with a first seat 23 internally obtained in the ogive 20, and a second end 22*b*, able to be coupled with a second seat 24 internally obtained in the closure bottom 25.

Both seats 23, 24 will have the proper shape suitable to warrant the perfect centering of the monolithic body 22 into the main hollow body 21.

According to a variant of the same embodiment of FIG. 4, and now shown in FIG. 7, the monolithic body 220 of the ballast element is made of a solid metal bar.

In FIG. 5 a further executive embodiment of the inactive bomb body of the invention is shown, generally indicated with numeral 400, which differs from the previously described ones in that the ballast element 26 consists of a monolithic hollow element 27 coaxially disposed inside the main hollow body 28 of the inactive bomb body 400.

In particular, the monolithic hollow element 27 is made by cold deformation of a metal tubular element, adherently coupled with the inner surface of said main hollow body 28 and the ogive 29 is the terminal end of the monolithic body 27.

In a different embodiment shown in FIG. 6, the ballast element 26 protrudes from the main hollow body 28 with a terminal end 29 ogive shaped.

According to the above described process, the junction of the two elements 27 and 28 ensures to the inactive bomb body 400 a variable thickness which is greater at the ogive 29, in order to give it the same ballistic features of active bomb bodies.

In other executive modifications of the hereby described embodiment, the ballast element could consist of different hollow elements coaxially disposed inside the main hollow body of the inactive bomb body according to this embodiment.

Concerning the ogive 29, also in this case it could be integral with the main hollow body, made by cold deformation of the metal tubular element or, alternatively, it could be a separate element, manufactured according to the previously described way, connected to the main hollow body 28 by welding. According to the invention, for all the above described and shown in FIG*s*. from 1 to 5 executive embodiments 1, 100, 200, 300 and 400, the forming of the main hollow body 2, 13, 16, 21 and 28 could be made, alternatively to the cold deformation, by hot forging of a metal tubular element.

As previously mentioned, it is pointed out that the above description, referred to inactive aerial bomb bodies, should be intended as applicable to any inactive ballistic element suitable for being used in military exercises.

According to what previously explained, it is thus clear that the inactive ballistic element of the invention, in particular an inactive aerial bomb body for exercises, achieves all the intended objects in all the described embodiments. In particular, it is achieved the object to provide for an inactive ballistic element for exercises which can be easily and economically recycled, to recover metallic material and aggregate contained therein, avoiding as well to discharge the used bomb bodies in proper dumps and/or dedicated sites.

It is therefore evident that, in this way, the double economic advantage deriving from the metallic material recovery and from saving the costs needed for discharging the inactive ballistic elements used is obtained.

It is furthermore achieved the object to provide for an inactive ballistic element for exercises which simplifies the known constructive technique and makes easier and more rapid the filling operation of the main hollow body with dried aggregates.

In the executive stage, modifications and variations, not described and not shown in the drawings, to the inactive ballistic element of the invention can be provided.

All the described and any other not cited embodiments, if they fall within the scope of protection of the following claims, should be intended as protected by the present patent.

The invention claimed is:

1. An inactive aerial ballistic element for exercises, comprising:

a main hollow body having a front portion and a rear portion;

a closure bottom, disposed at the rear portion of said main hollow body; and a ballast element, disposed in said main hollow body, able to give to said inactive ballistic element the same ballistic features as active ballistic elements, said ballast element including at least a monolithic body coaxially disposed in said main hollow body and extending at least completely between the closure bottom and the front portion of the main hollow body, wherein a front end of said monolithic body protrudes from the front portion of said main hollow body and forms an ogive of said inactive ballistic element.

2. The inactive ballistic element according to claim 1, further comprising a welded joint, wherein said main hollow body and said monolithic body consist of separate elements mutually connected by the welded joint.

3. The inactive ballistic element according to claim 1, wherein said monolithic body consists of a hollow metal element.

4. The inactive ballistic element according to claim 1, wherein said monolithic body is a solid metal bar.

5. The inactive ballistic element according to claim 1, wherein said monolithic body is adherently coupled with the inner surface of said main hollow body.

6. The inactive ballistic element according to claim 1, further comprising a welded joint, wherein said main hollow body and said ogive consist of separate elements mutually connected by the welded joint.

7. The ballistic element according to claim 1, further comprising a welded joint, wherein said closure bottom is connected to said main hollow body by the welded joint.

8. The ballistic element according to claim 1, wherein said ballistic element is an inactive aerial bomb body.

9. The inactive ballistic element according to claim 3, further comprising a welded joint, wherein said main hollow body and said monolithic body consist of separate elements mutually connected by the welded joint.

10. The inactive ballistic element according to claim 3, wherein said monolithic body is adherently coupled with the inner surface of said main hollow body.

11. The inactive ballistic element according to claim 3, further comprising a welded joint, wherein said main hollow body and said ogive consist of separate elements mutually connected by the welded joint.

12. The ballistic element according to claim 3, further comprising a welded joint, wherein said closure bottom is connected to said main hollow body by the welded joint.

13. The ballistic element according to claim 3, wherein said ballistic element is an inactive aerial bomb body.

14. The ballistic element according to claim 1, wherein said monolithic body is removably disposed within the main hollow body.

15. The ballistic element according to claim 14, wherein said main hollow body is a first main hollow body, and said monolithic body is removable from said first main hollow body for use in a second main hollow body.

16. The ballistic element according to claim 1, wherein said ballast element consists of the monolithic body.

17. The ballistic element according to claim 16, wherein said monolithic body consists of a solid metal bar.

18. The ballistic element according to claim 16, wherein said monolithic body consists of a hollow metal element.

19. The ballistic element according to claim 18, wherein an outside surface of said monolithic body is disposed in substantial contact with an inside surface of the main hollow body.

20. The ballistic element according to claim 18, wherein said monolithic body includes a front portion including said front end of said monolithic body, and a rear portion, and wherein a thickness of an outer wall of said monolithic body is substantially uniform at the rear portion of said monolithic body, and wherein the thickness of the outer wall of said monolithic hollow body in the front portion of said monolithic hollow body becomes gradually and continuously greater toward and until the front end of said monolithic hollow body.

* * * * *